United States Patent [19]

Boots

[11] Patent Number: 4,834,255

[45] Date of Patent: May 30, 1989

[54] CONTAINER FOR FREE-FLOWING MATERIALS, POWDERS, PELLETS AND THE LIKE

[76] Inventor: Gerardus A. M. Boots, Boskriek 70, 5401 LP Uden, Netherlands

[21] Appl. No.: 53,614

[22] Filed: May 26, 1987

[30] Foreign Application Priority Data

May 28, 1986 [NL] Netherlands ..... 8601365

[51] Int. Cl.[4] ..... B65D 5/36

[52] U.S. Cl. ..... 229/41 R; 229/41 C; 229/41 B; 229/109; 220/410

[58] Field of Search ..... 229/41 C, 109, 23 BT, 229/41 R, 41 B, 23 R, 4.5, 120.01; 220/415, 400, 408, 410; 206/8, 600

[56] References Cited

U.S. PATENT DOCUMENTS

| | | | |
|---|---|---|---|
| 3,115,292 | 12/1963 | Repking | 229/41 C |
| 3,937,392 | 2/1976 | Swisher | 229/41 C |
| 3,945,561 | 3/1976 | Strebelle | 229/41 B |
| 4,341,337 | 7/1982 | Beach, Jr. et al. | 229/41 C |
| 4,623,063 | 11/1986 | Balkin | 229/109 |

*Primary Examiner*—Willis Little

[57] ABSTRACT

A container for free-flowing materials, powders, pellets and the like, comprising a tubular outer envelope that can be closed at both ends and a tubular inner member having a circumference less than that of the outer envelope. The tubular inner member is connected to the outer envelope at at least four positions spaced circumferentially of the outer envelope and in the longitudinal direction of the tubular shapes, and has a length that is 30–100% of the selected height of the container.

10 Claims, 2 Drawing Sheets

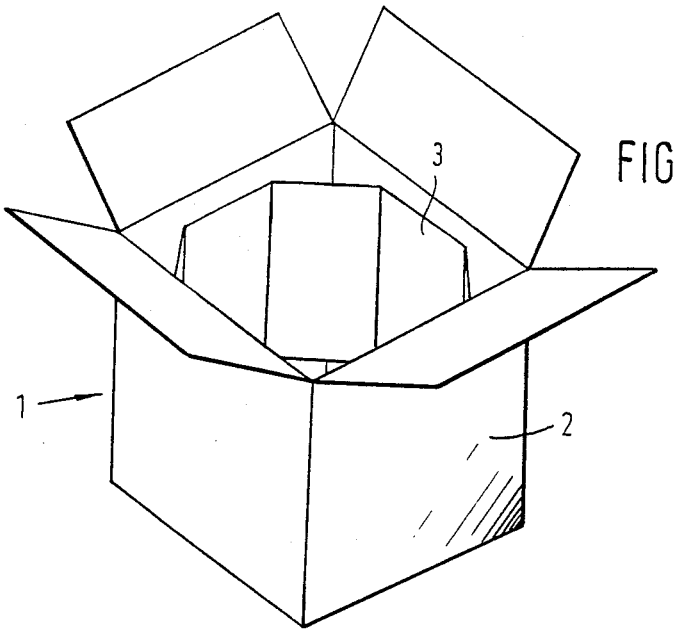
FIG. 1
FIG. 2
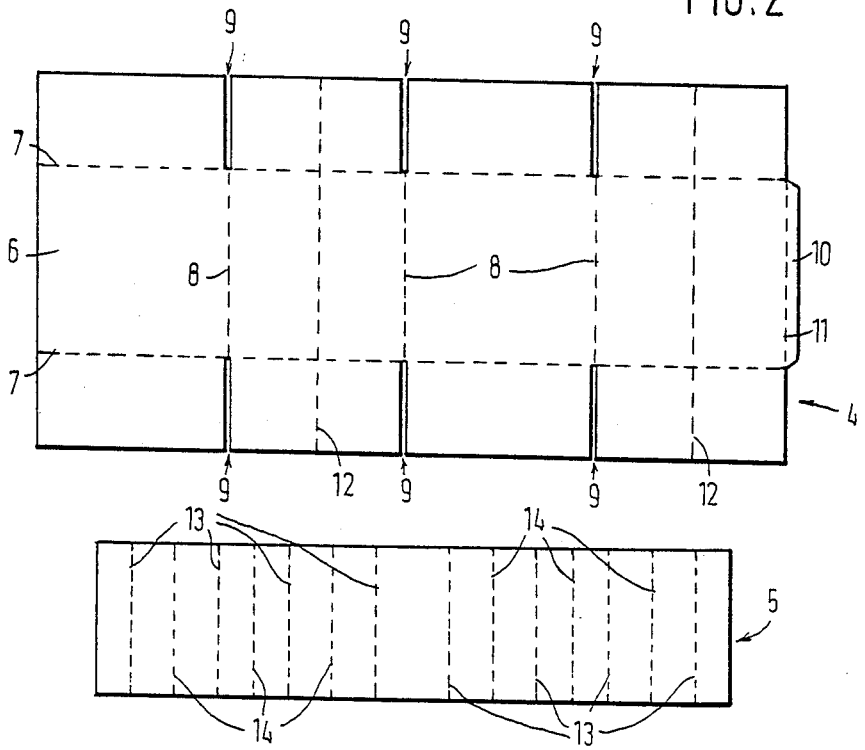

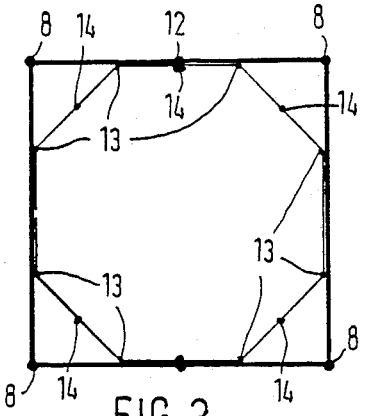
FIG.3
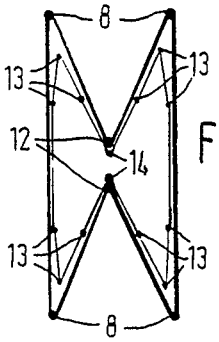
FIG.4
FIG.5
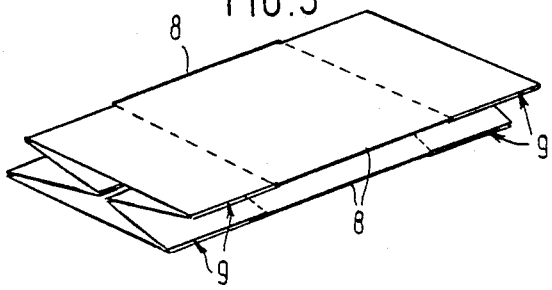
FIG.6
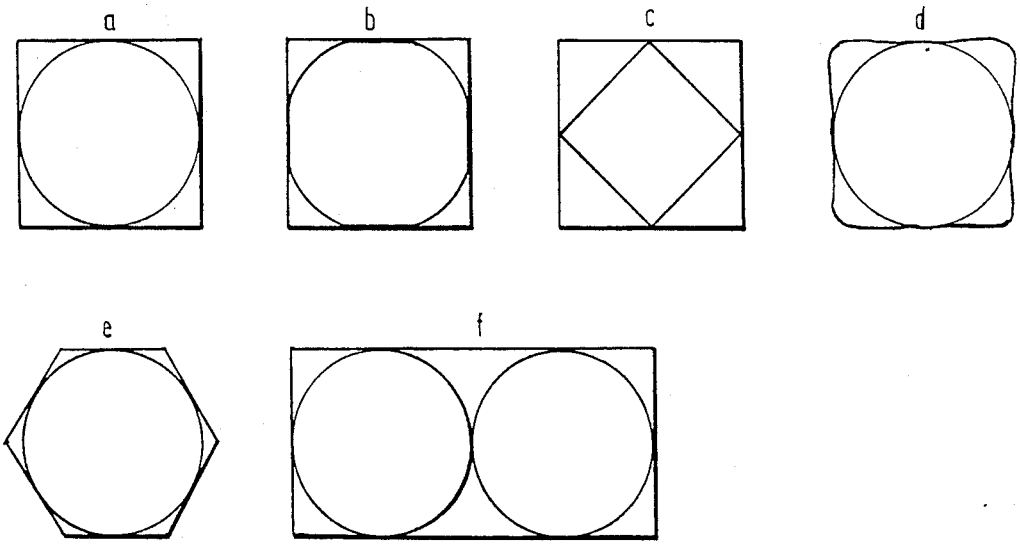

CONTAINER FOR FREE-FLOWING MATERIALS, POWDERS, PELLETS AND THE LIKE

This invention relates to a container for free-flowing materials, powders, pellets and the like, comprising a tubular outer envelope that can be closed at both ends and a tubular inner member having a circumference less than that of the outer envelope and bearing on said tubular outer envelope at at least four circumferentially spaced positions.

A container of this kind may take various forms, such as a box, a bag or a cask. Both boxes and bags have the great disadvantage of being prone to bulging, i.e., surfaces which are straight and flat in unloaded form will bulge when materials are introduced, which has a large number of disadvantages. In the first place, the required transport space will increase as a result of the dimensional instability of the boxes or bags without an increase in the effective amount of cargo to be transported, that is to say, there is a loss in shipping space as a result of the formation of empty spaces between the boxes or bags. Furthermore, bulging adversely affects the strength of a stack, so that less high stacks can be made than would be expected on the basis of the strength of the material which the container is made of and the weight of material to be contained. If the box or bag is made of cardboard or paper, moisture has a major influence on the strength of the container, so that the strength of a stack will decrease fast and dramatically when it becomes moist.

A container of the type described in the opening paragraph is disclosed in FR-A-No. 2 267 255. The tubular inner member, which extends throughout the entire height of the tubular outer envelope is placed loosely within the tubular outer envelope in this prior construction. The inner member serves, on the one hand, to reduce the volume of the box and, on the other hand, by means of flaps prepared in the inner member and the outer envelope during manufacture of the box, to provide a discharge aperture near the box bottom. The hollow spaces at the corner of the box can be utilized to provide stiffening elements. It is true that, with this last feature, the strength of a stack can be increased, but the bulging effect may likewise occur. Moreover, the effective shipping capacity of the box relative to one without a liner is considerably reduced.

It is an object of the present invention to provide a container of the kind defined in the opening paragraph hereof which is of optimum construction as regards dimensional stability, stacking strength and shipping configuration.

This is achieved, in accordance with the present invention, in that, at the positions referred to, the inner member is connected to the outer envelope in the longitudinal direction of the tubular shapes, the inner member having a length that is 30–100% of the selected height of the container.

These features effectively prevent bulging of the container by virtue of the tubular inner member, which relieves the sidewalls of the tubular outer envelope in full or for the greater part of the pressure exerted by the product contained in the tubular inner member, with which the spaces between the tubular inner member and the tubular outer envelope are also filled. Filling the interspaces can be realized in a simple manner by selecting the height of the tubular inner member smaller than that of the container, as a result of which the interspaces are in open communication—optionally at the top, at the bottom, or both—with the space within the tubular inner member and so will be automatically filled, the more so when a conventional vibratory filling device is used. It is also possible to provide cut-outs in the inner member to ensure the open communication contemplated. If, however, the container is to be filled with material of variable specific density, it may be preferably to select the height of the tubular inner member equal to that of the container. In that case first the inner member is fully filled, whereafter the interspaces are filled until the desired weight is obtained. The fully filled inner member will then ensure that the stacking strength of the container is unchanged relatively to a fully filled container, which amounts to a surprising additional advantage of the features proposed in accordance with this invention.

As the stacking strength is mainly dictated by the tubular inner member, moisture is in addition of considerably less influence on the stacking strength. In fact, the inner member, which is located fully within the outer envelope, will be protected against moisture in the same way as the packaged product, for example, by means of a waterproof layer on the inside of the outer envelope. Moisture which penetrates the outer envelope up to the waterproof layer will thus not be able to essentially affect the product, or the stacking strength, or the dimensional stability of the container, while, in addition, in choosing the material of the inner member, its moisture resistance need not be taken into consideration.

For that matter, virtually any desired material can be selected both for the outer envelope and for the inner member, while in addition any desired combination of materials is possible for the outer envelope and the inner member. Suitable materials are, for example, paper, paper in combination with other materials, synthetic plastics in the form of films, woven fabrics and synthetic materials, solid cardboard, corrugated cardboard, corrugated plastic board, plastic laminates, etc. It is also possible for the tubular inner member to take the form of a net.

The tubular inner member may be secured to the outer envelope at a plurality of spaced positions. Preferably, however, the tubular inner member is connected to the tubular outer envelope throughout its entire height. In that case, a correct position of the inner member within the outer envelope is always ensured. Also, in that case, the inner member may consist of two or more bands or strips, which may or may not be spaced in the direction of the height and/or the peripheral direction of the container.

A further preferred feature is that the tubular inner member is a cylindrical member, as this embodiment ensures maximum dimensional stability and minimum bulging, in particular when the tubular outer envelope is a rectangular box with a square bottom surface and the tubular inner member has a circular shape in cross-section. From considerations of manufacturing technique, it is preferable that the tubular outer envelope is a rectangular box with a square bottom surface and that the tubular inner member has an octagonal cross-sectional configuration. In that case, the container can be made with existing equipment without many problems. When, in this embodiment two opposed upright sidewalls are provided with a central upright folding line to enable said sidewalls to be folded inwardly, and each section of the tubular inner member intermediate two positions of connection with the tubular outer envelope is also provided with a central upright folding line to enable it to be collapsed, the container can be collapsed into a flat package and thus can be stored and shipped to the filling site with a minimum occupied space.

If the container is a box made of corrugated cardboard and/or corrugated plastic sheeting, it is preferable, and in accordance with a further embodiment of the present invention, that the longitudinal direction of the corrugations in the tubular outer envelope is perpendicular to that in the tubular inner member, because this renders the strength of the box virtually independent of the direction in which the corrugations of the material extend.

When the container is made of flexible material, it is preferable, and in accordance with a further embodiment of the present invention, that the tubular inner member is circular in section with a diameter equal to one-quarter of the circumference of the outer envelope. For that matter, by virtue of its non-bulging or hardly-bulging form in the filled condition, such a container readily admits of being placed afterwards in a box of more rigid material, for example, cardboard. This a further advantage of the features according to the present invention, which is fully expressed with filling devices designed to operate with flexible containers. Hitherto, it has been necessary to fold a further protection of more rigid material around the filled and hence bulging flexible container, with all problems inherent therein.

Some embodiments of the container according to the present invention will now be described and elucidated, by way of example, with reference to the accompanying drawings. In said drawings:

FIG. 1 shows a perspective view of a container according to the invention;

FIG. 2 shows the container of FIG. 1 in the form of a blank;

FIG. 3 shows a top plan view of the container shown in FIG. 1;

FIG. 4 shows the container of FIG. 1 in partially collapsed condition;

FIG. 5 shows a perspective view of the container of FIG. 1 in the collapsed condition; and FIGS. *6a* to *6f* show, in top plan view, a number of variants of the container shown in FIG. 1.

The container shown in FIG. 1 is a box 1 made, for example, of solid cardboard, corrugated cardboard, corrugated plastics board, or the like. The box 1 comprises an outer envelope 2 and an inner member or liner 3. The outer envelope 2 forms, in a conventional, known manner, the sidewalls and the bottom and cover of box 1, with the tubular inner member or liner 3 being connected with it at one or a plurality of places or strips, for example, by means of adhesive, stapling, heat sealing, stitching and the like. The inner member or liner 3 may consist of a plurality of circumferential bands or strips, which may or may not be spaced in the direction of the height of the container, and the inner member or liner 3 may alternatively consist of two or four tube sectors extending in the circumferential direction of the box.

The box 1 shown in FIG. 1 is made of two blanks as shown in FIG. 2. The outer envelope 2 is formed from blank 4 and the inner member 3 of blank 5.

Blank 4 comprises a central strip 6 defined by folding lines 7 and subdivided by folding lines 8 into four identical rectangular panels which will form the sidewalls of the box. Connected to each panel at both ends is a flap, with four flaps at one end of the central strip 6 together forming a cover or bottom, respectively. The flaps are separated by incisions 9. In order that the outer envelope 3 may be fixed in tubular form, the central strip is provided with an adhesive strip 10 which by means of a folding line 11 adjoins one of the panels. Furthermore, two folding lines 12 are provided which each divide a panel with adjoining flaps into two equal halves. The folding lines 12 are intended in order that the outer envelope 3, when erected into tubular shape, may be collapsed accordionwise, and are thus provided in two panels intended to form opposed sidewalls.

Blank 5 comprises a strip having a height between 30% and 100% of the height of a panel of blank 4 that is intended to form a sidewall, and is subdivided by folding lines 13 into a plurality of panels, the arrangement being such that blank 5 can be formed into an octagonal, tubular inner member 3, with opposed panels in the tubular form having equal dimensions. Furthermore, a number of folding lines 14 are provided which provide the possibility for the octagonal tubular inner member 3 to be collapsed accordion-wise together with the square, tubular outer envelope 2, which will be explained in more detail hereinafter with reference to FIGS. 3–5.

FIG. 3 shows the tubular outer envelope 2 and the inner member 3 in top plan view and shows the various folding lines, while FIG. 4 shows an intermediate phase as the container is being collapsed, to illustrate the directions in which the various parts move or pivot. FIG. 5, finally, shows the box in the collapsed condition.

In the above example, reference is made to a square outer envelope with an octagonal inner member. In addition to this configuration, many other shapes are possible. Some of these are illustrated, by way of example, in FIG. 6. FIG. *6a* shows a square outer envelope with a right-cylindrical inner member. FIG. *6b* shows the inner member composed alternately of circular and straight strips, and FIG. *6c* shows a square inner member rotated through 45° relatively to the square outer envelope. FIG. *6d* shows a circular inner member to which the outer envelope is secured at four positions offset through 90°, with the outer circumference of the outer envelope being equal to four times the diameter of the inner member. This embodiment is preferred if the container is made of flexible material, such as paper, paper in combination with other materials, synthetic plastics in the form of film, woven fabrics and synthetic materials, etc. It is also possible for the inner member to be made of a net. In this connection it is noted that a container made, for example, of paper or plastic-coated paper may be closed by means other than flaps. Thus, for example, salt or sugar containers may, in the collapsed condition, have the form as shown in FIG. 5, in which, however, flap incisions are absent. Closure can then be realized by closing the collapsed tubular form at one end by means of heat sealing of adhesive, whereafter a substantially rectangular bottom or top closure can be realized by folding this end in known manner. In FIG. *6e*, a circular inner member is surrounded by a hexagonal outer envelope, and in FIG. *6f*, two circular inner members are surrounded by a rectangular outer envelope. It should be noted that this is only a selection from the possible configurations, and the invention is not limited to the embodiments shown. Thus, for example, the container shown in FIG. *6d* of flexible material may be housed in a conventional, square box, i.e. a known box without a liner. Bulging of this box will not occur by reason of the presence of the inner member in the container of flexible material. The latter will acquire its substantially square configuration by filling the spaces between the outer envelope and the inner member, for example, by means of vibratory filling.

What I claim is:

1. A container for free flowing material, powders, pellets and the like, comprising: a tubular outer envelope defining a wall of a predetermined height and circumference including at least four substantially plane wall portions, said outer envelope being closeable at opposite ends transverse to the wall; and a tubular inner member having a circumference considerably smaller than that of the outer envelope including at least four contact portions, the tubular inner member engaging, and being affixed to, the outer envelope only at said contact portions, said contact portions being of a width considerably less than the width of the respective plane wall portion, the inner member having a height of about 30 to 100% of the height of the outer envelope.

2. A container according to claim 1, wherein the tubular inner member is affixed to the outer tubular member over its entire height at said contact portions.

3. A container according to claim 1, wherein the tubular inner member is a cylindrical member.

4. A container according to claim 1, wherein the tubular outer envelope has a square cross section and the tubular inner member has a circular cross section.

5. A container according as claimed in claim 1, wherein the tubular outer envelope has a square cross section and the tubular inner member has an octagonal cross section.

6. A container according to claim 1, wherein opposite ones of said plane wall portions each have a central folding line permitting folding of the respective wall portion inwardly, and wherein the tubular inner member has, intermediate two adjacent said contact portions, a central folding line permitting folding of the inner tubular member, to thereby permit collapsing of the container.

7. A container as claimed in claim 1, wherein the inner tubular member terminates short of the opposite ends of the outer envelope.

8. A container according to claim 1, wherein the tubular inner member is a net.

9. A container as claimed in claim 1, wherein the tubular outer envelope consists of corrugated cardboard of plastic with corrugations extending parallel to each other over the height of the wall, and wherein the tubular inner member consists of corrugated cardboard of plastic with corrugations extending perpendicular to those of the outer envelope.

10. A container as claimed in claim 1, wherein the tubular inner member has a circular cross section with a diameter equal to one-fourth of the circumference of the outer envelope.

* * * * *